US005638837A

United States Patent [19]

Juhl et al.

[11] Patent Number: 5,638,837

[45] Date of Patent: Jun. 17, 1997

[54] DEVICE, KIT AND METHOD OF CARING FOR A FINGER NAIL

[75] Inventors: Kathryn A. Juhl, Dallas County; S. Rozan Christian, Dallas; Max L. Christian, Sherman County; Karen Davis, Collin County, all of Tex.

[73] Assignee: Juhl, Christian and Christian, Inc., Dallas, Tex.

[21] Appl. No.: 410,335

[22] Filed: Mar. 24, 1995

[51] Int. Cl.[6] ..... A45D 29/00

[52] U.S. Cl. ..... 132/285; 132/73; 132/319; 132/76.2

[58] Field of Search ..... 132/285, 73, 76.2, 132/73.5, 75, 313, 319; 2/21; 206/581, 823, 229

[56] References Cited

U.S. PATENT DOCUMENTS

| | | | |
|---|---|---|---|
| 3,245,418 | 4/1966 | Dinerstein | 132/285 |
| 3,258,018 | 6/1966 | Tinsley | 132/285 |
| 3,382,878 | 5/1968 | Dinerstein | 132/285 |
| 3,592,202 | 7/1971 | Jones | 132/313 |
| 4,577,648 | 3/1986 | Dinerstein et al. | 132/73 |
| 5,513,754 | 5/1996 | Chang | 206/581 |

*Primary Examiner*—Nicholas D. Lucchesi
*Assistant Examiner*—Pedro Philogene
*Attorney, Agent, or Firm*—Lisa H. Meyerhoff; Winstead Sechrest & Minick P.C.

[57] ABSTRACT

A device used when applying polish to a tip of a finger nail includes a body having a size sufficient to prevent polish from being applied to a shielded portion of the finger nail away from the tip. A passageway extends through the body and has a size sufficient to receive the tip of the nail on one side of the body and allow access by a user of the device to the tip of the nail on the other side of the body. A kit adapted for applying polish to a tip of a finger nail includes the device. A kit includes a container of finger nail polish and an applicator to apply the polish to the tip of the nail after a finger is secured to the device to permit an individual to obtain a french type manicure. A method of applying polish to a tip of a finger nail constructs a device having a body made to expose the tip of the nail while shielding the remainder of the nail. The tip of the nail is positioned in the device to expose the tip while preventing access of the polish to the remainder of the nail. Polish is then applied to the tip of the nail.

24 Claims, 1 Drawing Sheet

DEVICE, KIT AND METHOD OF CARING FOR A FINGER NAIL

TECHNICAL FIELD

This invention relates to a device, kit and method used in manicuring a finger nail and, more particularly, to a device, a kit and a method used in providing a french manicure to a finger nail.

BACKGROUND ART

The caring for finger nails is well known. One of the methods used to care for finger nails is a french manicure that accentuates the white that naturally appears at the tip of the natural nail. The method involves applying a white or off-white polish in a uniform line at the tip of the nail while not applying such polish to the remainder of the nail. The remainder of the nail is that portion extending from the tip of the nail to the cuticle of the nail.

One method of obtaining a french manicure is by employing a highly skilled manicurist. A highly skilled manicurist is required because not all manicurists are capable of applying the polish along a uniform line at the exact location. Even though some manicurists believe that they possess the requisite skills to provide a french manicure, they fail. It then becomes necessary to remove the polish at the tip and apply polish in a conventional manicure. Accordingly, obtaining a french manicure from a manicurist is difficult, if not impossible, time consuming and expensive.

Also, a french manicure may be obtained by attaching masking tape to the tip of a nail before applying polish to the tip. The polish is then applied and the tape removed after the polish dries. This procedure is accomplished by using a kit, such as that sold by Orly International Inc. under the name ORLY French Manicure. However, because the polish dries simultaneously on the tape and along the tip of the nail, a portion of the polish along the tip may be removed with the tape, which causes irregularities along the line of the french manicure. When this occurs, the polish must be removed, new tape applied and the polish re-applied. The application of the masking tape is time consuming and the line of the manicure is not regular and is not as attractive as one desires.

Accordingly, it is an object of the present invention to provide a device that is used when applying polish to a tip of a finger nail to obtain a french manicure.

Further, it is an object of the present invention to provide a kit that is adapted for applying polish to a tip of a finger nail to obtain a french manicure.

Further, it is an object of the present invention to provide a method of applying polish to a tip of a finger nail to obtain a french manicure.

DISCLOSURE OF THE INVENTION

In accordance with the present invention there is provided a device used when applying polish to a tip of a finger nail. The device includes a body having a size sufficient to prevent polish from being applied to a shielded portion of the finger nail away from the tip. A passageway extends through the body and has a size sufficient to receive the tip of the nail on one side of the body and allow access by a user of the device to the tip of the nail on the other side of the body.

Further, in accordance with the present invention there is provided a kit adapted for applying polish to a tip of a finger nail. The kit includes a device having a body with a size sufficient to prevent polish from being applied to a shielded portion of the finger nail away from the tip. A passageway extends through the body and has a size sufficient to receive the tip of the nail on one side of the body and allow access by a user of the device to the tip of the nail on the other side of the body. The kit also includes a container of finger nail polish and an applicator to apply the polish to the tip of the nail after a finger is secured to the device to permit an individual to obtain a french type manicure.

Further, in accordance with the present invention there is provided a method of applying polish to a tip of a finger nail. A device is constructed that has a body made to expose the tip of the nail while shielding the remainder of the nail. The nail is positioned in the device to expose the tip while preventing access of the polish to the remainder of the nail. Polish is then applied to the tip of the nail.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
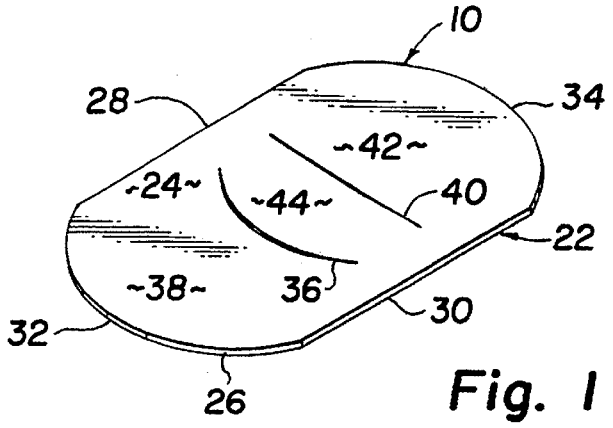
FIG. 1 is a perspective view of a device constructed according to the present invention.

Turning now to the drawings, there is shown a device 10 constructed according to the present invention. Device 10 is secured to a finger 12 and used when applying a polish 14 to a tip 16 of a nail 18 grown at the end 20 of finger 12.

Device 10 has a body 22 defined by front and back 24 and 26, respectively, first and second sides 28 and 30, respectively, and first and second ends 32 and 34, respectively. Front and back 24 and 26 face away from one another. First and second sides 28 and 30 are relatively straight and extend substantially parallel to one another. First and second ends 32 and 34, respectively, are disposed in a convex curve that generally faces away from one another, each curve having approximately the same radius of curvature that generally follows the contour of end 20 of finger 12.

A first passageway 36 extends through body 22 from front 24 to back 26 to allow access by a user of device 10 to tip 16 of nail 18 on front side 24 of body 22. First passageway 36 has a size at least sufficient to permit access of at least tip 16 of nail 18 into back 26 and through body 22. As shown in the drawings, first passageway 36 is an arcuate slit that extends substantially parallel to first end 32. First end 32 of body 22 and first passageway 36 are disposed sufficiently away one another so that body 22 and front 24 form a first shielding area 38. When tip 16 of nail 18 is inserted through first passageway 36, first shielding area 38 assists in preventing polish 14 from being accidentally applied to a surface other than that of front surface 24 of shielding area 38 and tip 16 of nail 18.

A second passageway 40 extends through body 22 from front 24 to back 26 to allow access by a user of device 10 to tip 16 of nail 18 on front 24 of body 22. Second passageway 40 has a size at least sufficient to permit access of at least tip 16 of nail 18 into back 26 and through body 22. As shown in the drawings, second passageway 40 is a straight slit that extends substantially transverse to the length of elongated finger 12 or substantially transverse to first and second sides 28 and 30, respectively. Second end 34 of body 22 and second passageway 40 are disposed sufficiently away one another so that body 22 and front 24 form a second shielding area 42. When tip 16 of nail 18 is inserted through second passageway 40, second shielding area 42 assists in preventing polish 14 from being accidentally applied to a surface other than that of front surface 24 of shielding area 42 and tip 16 of nail 18.

That portion of body 22 that is disposed between first passageway 36 and second passageway 40 provides a third shielding area 44 to cover that portion of nail 16 that is not receiving polish 14. When device 10 is properly secured to finger 12, third shielding area 44 is sealed against nail 18 to insure polish 14 is given a uniform line from one side to the other side across the nail by preventing polish 14 from passing under shielding area 44 onto the top of nail 18. When necessary, tip 16 of nail 18 may be urged against front 24 of body 22 to urge nail 18 into engagement with back 26 of shielding 44 of body 22 to obtain a proper seal with the top of nail 18. Further, third shielding area 44 prevents polish 14 from being applied to that portion of nail 18 that is not to be polished and to insure only tip 16 has polish 14 applied to it.

Figure 2:
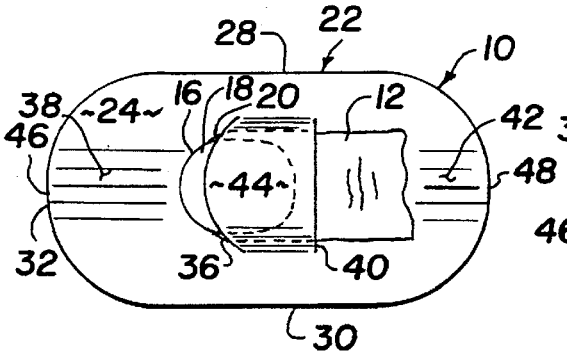
FIG. 2 is a plan view of the device shown in FIG. 1 after being secured to a finger and just prior to applying polish to the nail of the finger.
Figure 3:
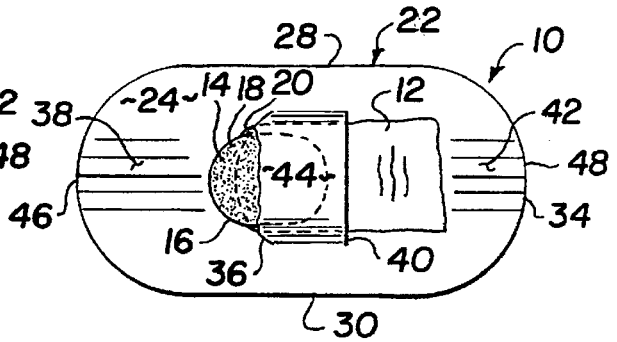
FIG. 3 is a plan view of the device shown in FIG. 1 after the polish has been applied to the nail.
Figure 4:
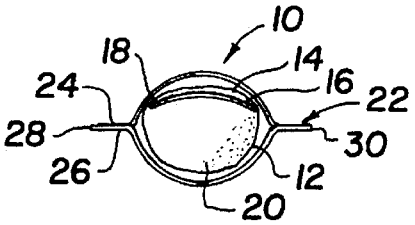
FIG. 4 is a end view of the device and finger shown in FIG. 3 after being deflected so as to remove it from a finger after the polish has been applied to the nail and before the polish has dried.
Figure 5:
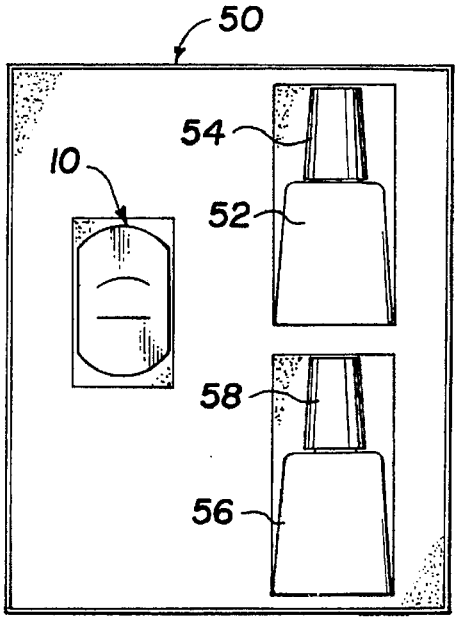
FIG. 5 is a plan view of the device shown in FIG. 1 after being provided in a kit to allow a french manicure.

A french manicure with a curved line that generally parallels first passageway 36 may be obtained by moving finger 12 along front 24, through second passageway 40, along back 26 and outward through first passageway 36 with tip 14 viewed from front 24. Finger 12 is disposed with tip 16 on front 24 between first shielding area 38 and third shielding area 44 and the remaining portion being disposed on back 26 of body 22, as shown in FIG. 2. If desired, finger 12 may be moved along back 26 and outward through first passageway 36 without passing through second passageway 40 to position tip 16 in the desired location. In either situation, body 22 must be sufficiently thin to allow this positioning of finger 12.

A french manicure with a straight line that generally parallels second passageway 40 is obtained by moving finger 12 along front 24, through first passageway 36, along back 26 and outward through second passageway 40 with tip 14 viewed from front 24. Finger 12 is disposed with tip 16 on front 24 between second shielding area 42 and third shielding area 44 and the remaining portion being disposed along back 26 of body 22. If desired, finger 12 may be moved alone back 26 and outward through second passageway 40 without passing through first passageway 36 to position tip 16 in the desired location. In either situation, body 22 must be sufficiently thin to allow this positioning of finger 12.

When device 10 is moved through first or second passageway 36 and 40, respectively, it is necessary that both passageways a size sufficient to receive finger 12 supporting nail 18 that is to be polished.

The materials and dimensions used to construct body 22 are chosen so that body 22 is sufficiently flexible to allow removal of body 22 from finger 12 without contacting polish 14 applied to nail 16 by moving or squeezing opposing first and second sides 28 and 30, respectively, toward one another and moving body 22 over tip 16 and end 20 of finger 12 while polish 14 is wet. It has been discovered that when the material is a plastic, front 22 and back 24 are about ⅛ inches from one another, first side 28 and second side 30 are about 1.5 from one another, outermost point 46 of first end 32 and outermost point 48 of second end 34 are about 2.5 inches from one another, first passageway 36 is about 1 inch from outermost point 46 and second passageway 40 is about 1.0 inch from outermost point 48, then body 22 will provide the desired flexibility to allow device 22 to function adequately.

Device 10 may be used in a kit 50 adapted to provide a french manicure. Kit 50 will include device 10 and a first containers 52 of finger nail white, off-white or similarly colored polish and an applicator 54, such as a brush connected to the top and disposed within container 52, to apply the polish to tip 14 of nail 16 after finger 12 is secured to device 10 as explained above. If desired, a second container 56 is provided with an applicator 58, such as a brush connected to the top and disposed within container 54, to apply an over coat to the first coat of polish.

In operation, device 10 is constructed to have a body 22 made to expose tip 16 of nail 18 while shielding the remainder of nail 18. Tip 16 of nail 18 is positioned in device 10 to expose tip 16 while preventing access of polish to the remainder of nail 18. Polish is then applied to tip 16 of nail 18. Body 22 of device 10 is constructed to form first shielding area 38 and second shielding area 42 to assist in preventing polish from being applied to a surface other than that of shielding area 38 and 42 and tip 16 of nail 18 and to form third shielding area 44 to prevent polish from being applied to nail 18 except for tip 16.

The invention having been described, what is claimed is:

1. A device used when applying polish to a tip of a finger nail at the end of a finger having a top surface, first and second side surfaces, a bottom surface and a tip, comprising:

a body having a size sufficient to prevent polish from being applied to a shielded portion of the finger nail away from the tip, said body having a first end and a second end, wherein said first end of the body adapted to be disposed against the bottom surface of the finger away from the tip of said finger; and first and second passageways extending through said body, each passageway having a size sufficient to receive the tip of the nail on one side of said body and allow access by a user of the device to the tip of the nail on the other side of said body to secure the device to said finger.

2. A device as set forth in claim 1, further comprising: said body being sufficiently flexible to allow removal of said body from a finger supporting the nail without contacting the polish applied to the nail by moving opposing sides of said body toward one another.

3. A device as set forth in claim 1, wherein the first end of the body is disposed sufficiently away from passageways to form a shielding area to assist in preventing polish from being applied to a surface other than that of the shielding area around the nail.

4. A device as set forth in claim 1, wherein each passageway is an elongated slit extending through said body and having a length sufficient to receive that portion of the nail extending between a cuticle on each side of the nail.

5. A device as set forth in claim 4, wherein the slit of the first passageway is generally arcuate and disposed to generally follow the contour of the end of the finger supporting the nail to which the polish is applied.

6. A device as set forth in claim 4, wherein the slit of the first passageway is generally straight and disposed to extend transversely relative to the end of the finger supporting the nail to which the polish is applied.

7. A device as set forth in claim 1, wherein each passageway is an elongated slit extending through said body and having a size sufficient to receive a finger supporting the finger nail to be polished.

8. A device as set forth in claim 4, wherein the slit of said first passageway is generally arcuate and disposed to generally follow the contour of the end of the finger supporting the nail to which the polish is applied, and the slit of said second passageway is generally straight and disposed to generally extend transversely relative to the end of the finger supporting the nail to which the polish is being applied.

9. A device as set forth in claim 8, further comprising: the slit of the first passageway being displaced from the slit of the second passageway by a distance sufficient to cover the shielded portion of the nail.

10. A device as set forth in claim 9, further comprising: said body having a first generally straight side, and a second generally straight side, the first and second generally straight sides being disposed generally parallel to and away from one another by about 1.5 inches, a first arcuate side, a second arcuate side, the first and second arcuate sides having outermost points, the outermost points being disposed away from one another by about 2.5 inches, and each of said passageways being disposed in said body about 1.0 inches away from the respective outermost points.

11. A kit adapted for applying polish to a tip of a finger nail at the end of a finger having a top surface, first and second side surfaces, a bottom surface and a tip, comprising:

a device used when applying polish to the tip of a finger nail, comprising:

a body having a size sufficient to prevent polish from being applied to a shielded portion of the finger nail away from the tip, said body having a first end and a second end, wherein said first end of the body adapted disposed against the bottom surface of the finger away from the tip of said finger; and first and second passageways extending through the body, each passageway having a size sufficient to receive an end of the nail on one side of the body and allow access by a user of the device to the tip of the nail on the other side of the body to secure the device to said finger;

a container of finger nail polish for application of finger nail polish to the tip of the finger nail; and an applicator to remove finger nail polish from the container and apply the polish to the tip of the nail after a finger is secured to said device.

12. A kit as set forth in claim 11, further comprising: the body of said device being sufficiently flexible to allow removal of the body from a finger supporting the nail without contacting the polish applied to the nail by moving opposing sides of the body toward one another.

13. A kit as set forth in claim 11, wherein the first end of the body is disposed sufficiently away from said passageways to form a shielding area to assist in preventing polish from being applied to a surface other than that of the shielding area around the nail.

14. A kit as set forth in claim 11, wherein each passageway of said device is an elongated slit extending through said body and having a length sufficient to receive that portion of the nail extending between a cuticle on each side of the nail.

15. A kit as set forth in claim 14, wherein the slit of the first passageway of said device is generally arcuate and disposed to generally follow the contour of the end of the finger supporting the nail to which the polish is applied.

16. A kit as set forth in claim 14, wherein the slit of the first passageway of said device generally straight and disposed to extend is generally transversely relative to the end of the finger supporting the nail to which the polish is applied.

17. A device as set forth in claim 11, wherein each passageway of the body of said device is an elongated slit extending through the body and having a size sufficient to receive a finger supporting the finger nail to be polished.

18. A kit as set forth in claim 14, wherein the slit of the first passageway of the body of said device is generally arcuate and disposed to generally follow the contour of the end of the finger supporting the nail to which the polish is applied, and the slit of the second passageway of the body of the device is generally straight and disposed to generally extend transversely relative to the end of the finger supporting the nail to which the polish is applied.

19. A kit as set forth in claim 18, further comprising: the slit of the first passageway of the body of said device being displaced from the, slit of the second passageway by a distance sufficient to cover the shielded portion of the nail.

20. A kit as set forth in claim 19, further comprising: the body of said device having a first generally straight side, and a second generally straight side, the first and second generally straight sides being disposed generally parallel to and away from one another by about 1.5 inches, a first arcuate side, a second arcuate side, the first and second arcuate sides having outermost points, the outermost points being disposed away from one another by about 2.5 inches, and each of the passageways being disposed in the body about 1.0 inches away from the respective outermost points.

21. A method of applying polish to a tip of a finger nail at the end of a finger having a top surface, first and second side surfaces, a bottom surface and a tip, comprising the steps of:

constructing a device having a body made to expose the tip of the nail while shielding the remainder of the nail, said device having a first end and a second end, wherein said first end the body adapted to be disposed against the bottom surface of the finger away from the tip of said finger; and said device adapted to have first and second passageways extending through said body each passageway having a size sufficient to receive the tip of the nail on one side of said body and allow access by a user of the device to the tip of the nail on the other side of said body to secure the device to said finger;

positioning the tip of the nail in the device to expose the tip while preventing access of the polish to the remainder of the nail;

positioning the first end of the body against the bottom surface of the finger away from the tip of said finger; and applying polish to the tip of the nail.

22. A method of applying polish to a nail as set forth in claim 21, comprising the further step of: constructing the body of the device to form a shielding area to assist in preventing polish from being applied to a surface other than that of the shielding area and the tip of the nail.

23. A method of applying polish to a nail as set forth in claim 21, comprising the further step of: constructing the device to have first and second passageways extending through the body, each passageway having a size sufficient to receive the tip of the nail on one side of the body and allow access by a user of the device to the tip of the nail on the other side of the body for applying polish.

24. A method of applying polish to a nail as set forth in claim 23, comprising the further step of: constructing each passageway as an elongate slit extending through the device and having a size sufficient to receive a finger supporting the finger nail to be polished.

* * * * *